United States Patent [19]

Ito et al.

[11] Patent Number: 4,600,862

[45] Date of Patent: Jul. 15, 1986

[54] DISCHARGE LAMP OPERATION APPARATUS

[75] Inventors: Kazuhiko Ito, Moriguchi; Takashi Katsura, Osaka; Masataka Ozawa, Hirakata; Kazutaka Koyama, Nishinomiya; Yoshiro Ogata, Ibaraki, all of Japan

[73] Assignee: Matsushita Electric Industrial Co. Ltd., Osaka, Japan

[21] Appl. No.: 658,414

[22] Filed: Oct. 5, 1984

[30] Foreign Application Priority Data

Oct. 12, 1983 [JP] Japan ..... 58-190107
Nov. 15, 1983 [JP] Japan ..... 58-215422

[51] Int. Cl.[4] ..... H01J 17/20; H01J 11/04

[52] U.S. Cl. ..... 315/358; 313/571; 313/573; 313/634; 313/639; 313/642; 315/200 R

[58] Field of Search ..... 315/358, 200 R; 313/639, 573, 571, 634, 642, 620

[56] References Cited

U.S. PATENT DOCUMENTS

| | | | |
|---|---|---|---|
| 2,094,694 | 10/1937 | Bol et al. | 315/358 |
| 3,054,922 | 9/1962 | Louden et al. | 313/571 |
| 3,898,504 | 8/1975 | Akutsu et al. | 313/639 |
| 4,539,513 | 9/1985 | Ganser et al. | 315/200 R |

*Primary Examiner*—Harold Dixon
*Attorney, Agent, or Firm*—Spencer & Frank

[57] ABSTRACT

A high-pressure sodium lamp is connected to a d.c. power supply through a ballast, to operate it with a current containing a d.c. component. The relation between the ratio l/d of the inter-electrode distance l (mm) to the inner diameter d (mm) of the arc tube of the high-pressure sodium lamp and the sodium vapor pressure $P_{Na}$ (kPa) in the arc tube is maintained at $P_{Na} \geqq 6.0$ $(l/d-5.8)$, thus making it possible to operate the high-pressure sodium lamp with a current containing a d.c. component without causing a significant color separation which otherwise might be the result of cataphoresis.

2 Claims, 3 Drawing Figures

DISCHARGE LAMP OPERATION APPARATUS

The present invention relates to an operation apparatus for a high-pressure sodium lamp.

A discharge lamp is normally supplied with power through an inductive ballast. The current limiter is required in view of the fact that the discharge lamp has a negative voltage-current characteristic. The disadvantage of the inductive ballast is that it is heavy posing a roadblock to reduction in size and weight of the ballast.

In recent years, a method has been developed to reduce the size and weight of the ballast by high-frequency operation of the discharge lamp. Operation of the discharge lamp at high frequency, however, causes what is called an acoustic resonance at a frequency specific to the lamp, thus making the arc unstable. Various methods to overcome the acoustic resonance that have so far been suggested have advantages and disadvantages and have not yet been successfully commercialized.

On the other hand, there is a method of operating the discharge lamp with direct current, which method is considered to cause a cataphoresis, thereby leading to a color separation in the arc tube.

The object of the present invention is to provide a compact, light-in-weight and low-cost discharge lamp operation apparatus which operates a high-pressure sodium lamp with current containing d.c. component without any significant color separation.

According to the present invention, there is provided a discharge lamp operation apparatus comprising a d.c power supply, a ballast connected across the d.c. power supply and a high-pressure sodium lamp operated by a current containing d.c. component connected to the d.c. power supply through the ballast, wherein the arc tube has a distance l mm between electrodes, the ratio l/d between the inter-electrode distance l and the tube inner diameter d, and the sodium vapor pressure $P_{Na}$ (kPa) in the tube, which are related to each other as $P_{Na} \geqq 6.0$ (l/d−5.8), whereby the significant color separation due to the cataphoresis is prevented in operation with a current containing a d.c. component.

The present invention will be apparent from the following detailed description taken in conjunction with the accompanying drawings, in which.

An embodiment of the present invention will be explained below with reference to the accompanying drawings.

Figure 1:
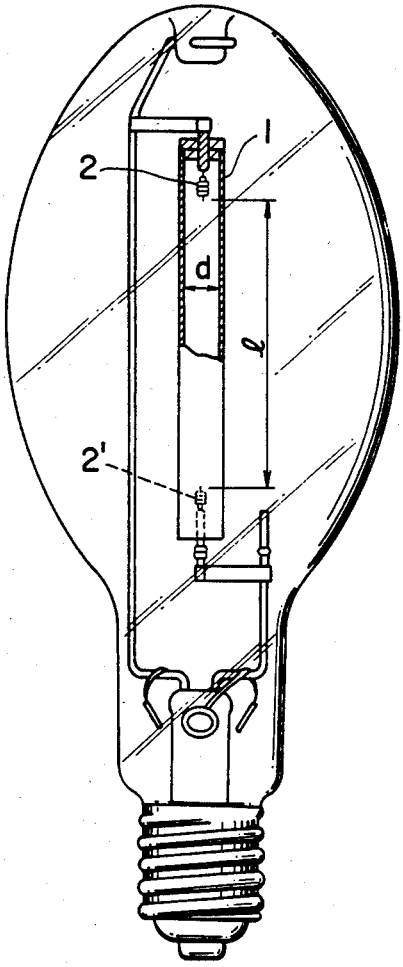
FIG. 1 is a partially-cutaway front view of a high-pressure sodium lamp used with a discharge lamp operation apparatus according to an embodiment of the present invention.

An example of the construction of a high-pressure sodium lamp according to the present invention is shown in FIG. 1. In FIG. 1, reference numeral 1 designates an arc tube of alumina ceramics, and 2, 2′ electrodes. The arc tube is sealed with a predetermined amount of sodium and mercury and a starting rare gas such as xenon, argon or neon. A metal foil may be wound on the tube ends near the electrodes in order to improve the sodium vapor pressure while the lamp is lighted.

Figure 2:
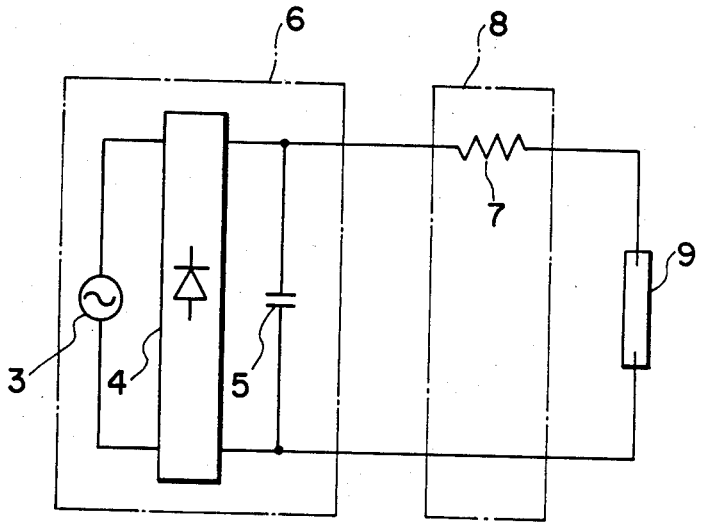
FIG. 2 is a circuit diagram of the same apparatus.

A circuit diagram of a discharge lamp operation apparatus according to an embodiment of the present invention is shown in FIG. 2. In FIG. 2, numeral 3 designates an a.c. power supply, numeral 4 a rectifier circuit, numeral 5 a smoothing capacitor, numeral 6 a d.c. power supply, numeral 7 a lamp current-limiting resistor, numeral 8 a ballast, and numeral 9 a high-pressure sodium lamp shown in FIG. 1 having an arc tube l mm in inter-electrode distance an d mm in inner diameter.

The arc tube of the high-pressure sodium lamp is sealed with sodium, mercury, and xenon gas, neon gas or argon gas as a starting rare gas in such a relation that $P_{Na} \geqq 6.0$ (l/d−5.8) where $P_{Na}$ (kPa) is the sodium vapor pressure while the lamp is on.

The relation between the inner diameter d mm of the arc tube, the inter-electrode distance l mm and the sodium vapor pressure $P_{Na}$ (kPa) in the arc tube while the lamp is on will be explained.

Figure 3:
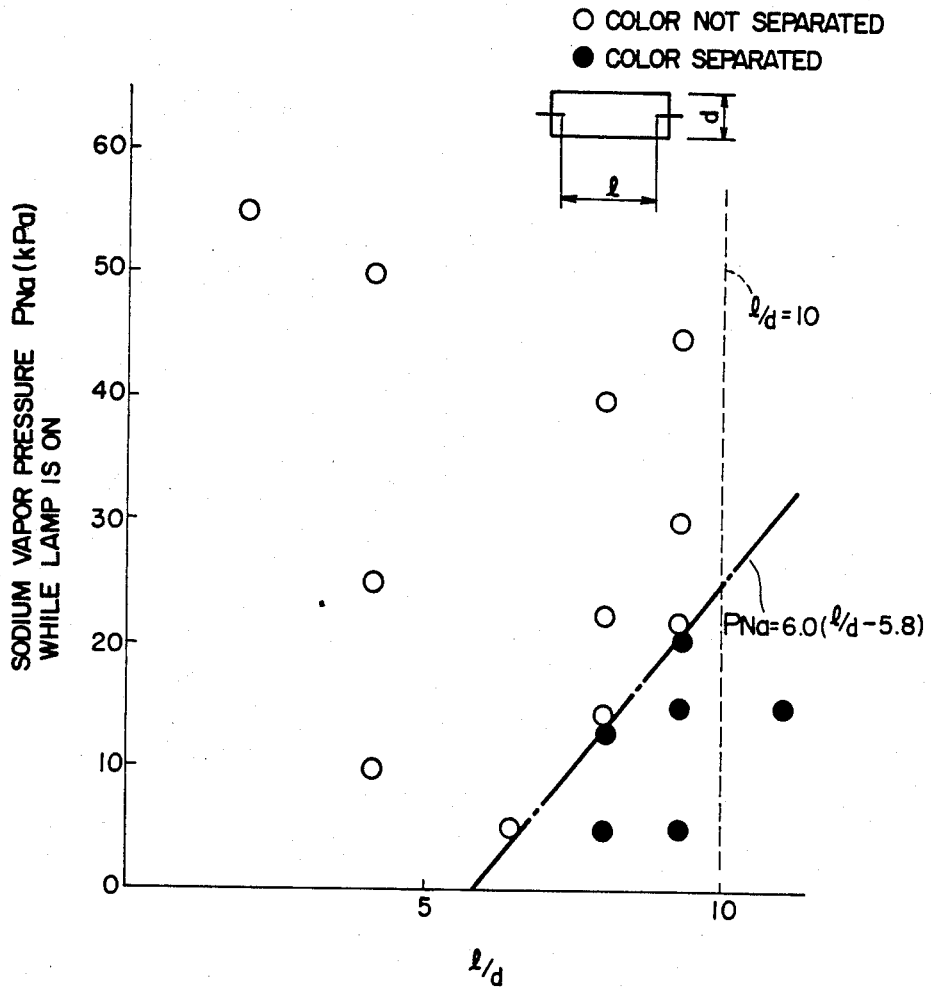
FIG. 3 is a characteristic diagram showing the relation between the ratio l/d between the inter-electrode distance l and the tube inner diameter d and the sodium vapor pressure $P_{Na}$ under operated condition of the high-pressure sodium lamp using the operation apparatus according to the present invention.

Assume that high-pressure sodium lamps with different tube inner diameters d mm of the arc tube and inter-electrode distance l mm and rated color temperature are turned on with various d.c. currents. As shown in FIG. 3, a significant color separation is caused due to cataphoresis in the region where the sodium vapor pressure in the arc tube $P_{Na}$ (kPa) is $P_{Na} < 6.0$ (l/d−5.8) under the line represented by $P_{Na} = 6.0$ (l/d−5.8). In the region where the sodium vapor pressure $P_{na} \geqq 6.0$ (l/d−5.8) above the straight line represented by $P_{na} = 6.0$ (l/d−5.8), on the other hand, there is no such a cataphoresis observed as to cause a significant color separator.

This indicates the fact that a high-pressure sodium lamp can be operated with direct current without any practical problem of color separation, if the shape of the arc tube, the material sealed and the operated condition thereof are determined in such a manner that there is a relation $P_{Na} \geqq 6.0$ (l/D−5.8) between the sodium vapor pressure $P_{na}$ (kPa) of the lamp turned on and the ratio between the inner diameter d mm and the inter-electrode distance l mm of the arc tube of the high-pressure sodium lamp.

The reason why a significant color separation is not caused by the cataphoresis is that the amount of sodium in the discharge gas in the arc tube is maintained more than a predetermined level against the ratio l/d of the tube even in the case where the tube inner diameter d is so small in comparison with the inter-electrode distance l that diffusion or convection is not easy.

Specifically, when the high-pressure sodium lamp is lighted with direct current, a sodium density gradient would occurs in the discharge gas as the sodium movement is balanced resulting from the factor that (1) sodium ions are attracted toward the negative electrode by the electric field, (2) the sodium ions attracted to the negative electrode increases the amount of sodium around the negative electrode so that sodium is diffused toward the positive electrode from the negative electrode, and that (3) sodium ions move by the convection in the light-emission tube.

In the high-pressure sodium lamp according to the present invention, however, even in the event that the tube inner diameter d is so small as compared with the interelectrode distance l of the arc tube that the diffusion (2) and convection (3) are reduced to increase the sodium density gradient in the discharge gas, the sodium vapor pressure $P_{Na}$ is maintained at $P_{na} \geqq 6.0$ (l/d−5.8), thus preventing sodium from being extremely reduced in amount in any part of the discharge gas.

As a result, sodium can emit light over the whole arc tube, thus preventing significant color separation of the tube.

As explained above, a high-pressure sodium lamp according to the present invention is such that the relation between sodium vapor pressure $P_{na}$ and the ratio between the tube inner diameter d (mm) and the inter-electrode distance l (mm) of the arc tube is maintained at $P_{na} \geqq 6.0$ (l/d−5.8) while the lamp is lighted, whereby the lamp can be lighted with direct current with a compact, light-in-weight and low-cost ballast.

In a high-pressure sodium lamp with a large inter-electrode distance l as compared with the inner diameter d of the arc tube, it is generally necessary to increase the lamp power in order to secure a predetermined luminance. If both the lamp power and the inter-electrode distance l are large, however, the wall temperature at the central part of the arc tube is increased. As a consequence, the amount of sodium lost from the arc tube is increased thereby to deteriorate the lamp service life characteristic. If the inner diameter d is small as compared with the inter-electrode distance l of the arc tube, it is necessary to increase the tube wall load (=lamp power divided by surface area of tube wall) in order to secure a sodium vapor pressure required for predetermined luminance. The result is an increase tube wall temperature thereby to deteriorate the lamp service life characteristic as in the preceding case. In other words, an increased ratio between the interelectrode distance l and the inner diameter d of the arc tube poses a problem of deteriorated lamp service life characteristic due to the requirement to secure a predetermined lamp luminance. If the ratio l/d of the arc tube is maintained less than 10, however, a lamp free of any practical problem is obtained.

In the embodiment under consideration, the d.c. power supply 4 which is a rectification of the a.c. power supply 1 may be replaced with another construction or with a storage battery which may double as a ballast 6. Also, the output voltage of the d.c. power supply 4 may be smoothed or in pulsation form. The ballast 6, which includes a resistor 5 in the embodiment, may be replaced by another means which limits the lamp current or a bulb or other switching means such as a d.c. chopper or an inverter. Further, the ballast may be connected with a lamp starter. Furthermore, a d.c. power superimposed on a.c. power may be used as a power supply.

The high-pressure sodium lamp may be efficiency-oriented type, improved color rendering type or color rendering-oriented type so far as it is so designed as to cause expansion and self-absorption of the sodium D resonance line at the time of rated input.

What is more, the starter for starting the lamp may be built in the ballast or lamp or may be separately provided.

It will be understood from the foregoing description that according to the present invention, there is provided a discharge lamp orientation apparatus which is capable of operating a high-pressure sodium lamp with a current containing a d.c. component without causing any significant color separation which otherwise might occur due to the cataphoresis, so that a resistor and electronic circuit may be used as a ballast thereby to reduce the size and weight of the ballast.

We claim:

1. A discharge lamp operation apparatus comprising a d.c. power supply, a ballast connected to the output terminal of said d.c. power supply, and a high-pressure sodium lamp connected to said d.c. power supply through said ballast and adapted to be operated by a current containing a d.c. component, wherein the relation between the ratio of the distance l (mm) between the electrodes to the inner diameter d (mm) of the arc tube of the high-pressure sodium lamp and the sodium vapor pressure $P_{Na}$ (kPa) in the arc tube is set to $P_{Na} \geqq 6.0$ (l/d−5.8).

2. A discharge lamp operation apparatus according to claim 1, wherein the ratio l/d between the inter-electrode distance l (mm) and the inner diameter d (mm) of the arc tube is maintained at a value smaller than ten.

* * * * *